US005758806A

United States Patent [19]

Anderson

[11] Patent Number: 5,758,806

[45] Date of Patent: Jun. 2, 1998

[54] EXTRA-LARGE CLOTHES HANGER

[76] Inventor: Dennis J. Anderson, 503 River Ter., Endicott, N.Y. 13760

[21] Appl. No.: 749,272

[22] Filed: Nov. 13, 1996

[51] Int. Cl.[6] ..... A47G 25/20; A47G 25/14

[52] U.S. Cl. ..... 223/92; 223/87; 223/85

[58] Field of Search ..... 223/85, 92, 87; D6/315, 318

[56] References Cited

U.S. PATENT DOCUMENTS

| | | | |
|---|---|---|---|
| D. 29,038 | 1/1898 | Heaton | 223/85 |
| 491,062 | 1/1893 | Ganger | 223/85 |
| 952,202 | 3/1910 | Klingenfeld | 223/89 |
| 1,797,364 | 7/1931 | Porter | 223/92 |
| 2,378,922 | 6/1945 | Grant | 223/85 |
| 2,609,977 | 9/1952 | Lausch | 223/92 |
| 2,827,211 | 3/1958 | Bradley | 223/89 |
| 3,638,890 | 2/1972 | Burrell et al. | D6/318 |
| 4,300,688 | 11/1981 | London | 223/94 |
| 5,038,978 | 8/1991 | Kolton et al. | 223/92 |

FOREIGN PATENT DOCUMENTS

| | | | |
|---|---|---|---|
| 897160 | 5/1962 | United Kingdom | 223/92 |

*Primary Examiner*—Bibhu Mohanty
*Attorney, Agent, or Firm*—Salzman & Levy

[57] ABSTRACT

The present invention features a large-sized clothes hanger for use with clothing worn by the oversized man or woman. This hanger has a body that is generally arcuate in shape, and which is very nearly semi-circular in appearance. This semi-circular appearance may be further defined as having a substantially full, arcuate chord that approaches a diameter length of a circle. The body dimensions of the hanger are approximately 20.5" across, approximately 10.25" high, and with a circumference that is approximately 32" from tip-to-tip in length. The circumferential distance of the body of the hanger is enhanced by two dog-eared extensions, with each respectively positioned at each distal end or tip of the hanger body.

3 Claims, 1 Drawing Sheet

EXTRA-LARGE CLOTHES HANGER

FIELD OF THE INVENTION

The present invention pertains to clothes hangers and, more particularly, to a clothes hanger made specifically for individuals whose clothing is sized extra-large.

BACKGROUND OF THE INVENTION

People of very large or very small size are discriminated against in ways both subtle and overt. One area in which people of large girth are disadvantaged is the retail clothing market. When a large person visits a typical clothing store, he or she usually cannot find the right size. In the rare instances that a person does find the correct size, the selection availability is usually quite sparse.

Recently however, shops have been established that cater to large-sized individuals. Large individuals can now frequent these specialty shops and obtain the proper clothing sizes. There is, however, one outstanding problem still remaining: larger garments are usually hung upon ordinary or standard-sized clothes hangers. Standard hangers do not adequately support larger clothes, which will become wrinkled and disheveled as they hang in the closet.

Hangers have been developed in which the dimensions of the hanger body can be varied or adjusted to suit clothing of different shapes or sizes. Such hangers are shown in U.S. Pat. Nos. 5,085,358 (issued on Feb. 4, 1992, to LAM, and entitled "Adjustable Clothes Hanger"); U.S. Pat. No. Des. 365,447 (issued on Dec. 26, 1995, to NORTH, and entitled "Expandable Clothes Hanger"); and U.S. Pat. No. Des. 666,608 (issued on Jan. 22, 1901, to MARBLE, and entitled "Garment Holder").

The aforementioned hangers are adequate in supporting large garments, but they are complicated in function, and are costly to manufacture. What is really needed is a hanger that is simply larger in dimension, so as to accommodate the large person's wardrobe. Although clothes hangers have been around for hundreds of years, to the best of the inventor's knowledge, no one to date has seen fit to make a hanger that is simply bigger.

The present invention overcomes the deficiency present in the hanger industry for many years. The current invention features a clothes hanger of larger dimensions, one that will adequately support and shape the extra-large clothing of the large man or woman.

The hanger of this invention has a body that is approximately 20.5" across, approximately 10.25" high, and with a circumference that is approximately 32" from tip-to-tip in length.

SUMMARY OF THE INVENTION

In accordance with the present invention, there is provided a large-sized clothes hanger for use with clothing worn by the oversized man or woman. This hanger has a body that is generally arcuate in shape, and which is very nearly semi-circular in appearance. This semi-circular appearance may be further defined as having a substantially full, arcuate chord that approaches a diameter length of a circle.

The body dimensions of the hanger are approximately 20.5" across, approximately 10.25" high, and with a circumference that is approximately 32" from tip-to-tip in length. The circumferential distance of the body of the hanger is enhanced by two, dog-eared extensions, with each respectively disposed at each distal end or tip of the hanger body.

It is an object of this invention to make a hanger that is both simple and cost-effective for the use of large-sized individuals.

It is another object of this invention to fabricate and design for large-size individuals a hanger that does not require adjustments.

BRIEF DESCRIPTION OF THE DRAWINGS

A complete understanding of the present invention may be obtained by reference to the accompanying drawings, when considered in conjunction with the subsequent, detailed description, in which.

For purposes of brevity and clarity, like elements and components will bear the same designations or numbers throughout the FIGURES.

DESCRIPTION OF THE PREFERRED EMBODIMENT

Generally speaking, this invention is for a clothes hanger having oversized dimensions that will accommodate clothing of individuals whose clothes size exceeds extra-large. This hanger has a substantially semi-circular body appearance, and a lengthy circumferential dimension that is enhanced by two dog-ears, one of which is disposed on each distal end of the hanger body.

Figure 1:
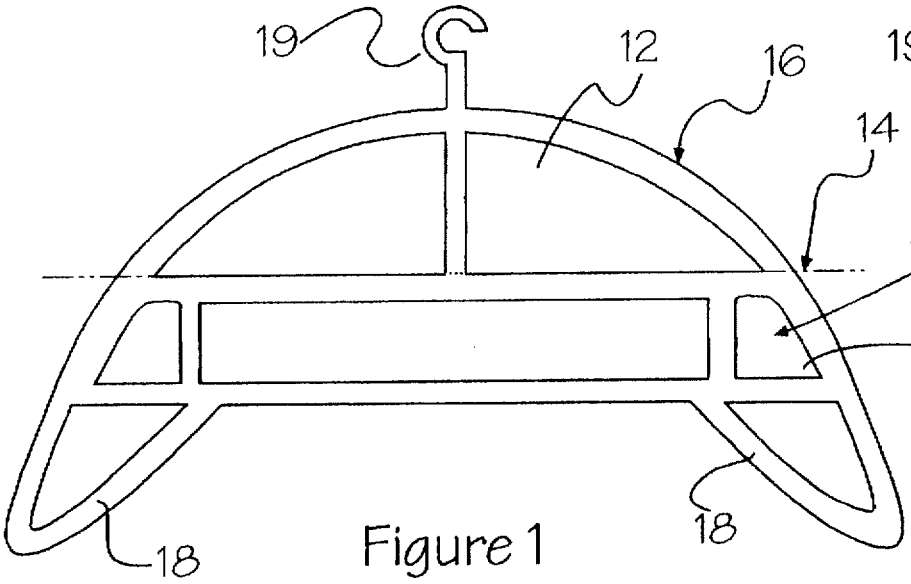
FIG. 1 illustrates a front view of the hanger of this invention as it is superimposed upon a standard hanger.

Now referring to FIG. 1, the oversized hanger 10 of this invention is shown superimposed upon a standard-sized hanger 12; the pattern thereof is delineated at line 14. The circumference 16 of the hanger 10 is substantially semi-circular in appearance. This semi-circular appearance may be further defined as having a substantially full, arcuate chord that approaches a diameter length of a circle. The arcuate hanger 10 features a pair of dog-ears 18, with one on each of its distal ends. These dog-ears 18 enhance the circumferential length of the hanger 10, and provide the extra dimensional enhancement needed to accommodate large-sized clothing. The hanger body 15 can comprise cardboard, paper, wood, plastic or metal materials. The hanger 10 has a hook 19 attached at its top, for attachment about a closet pole (not shown), a wall protuberance or a nail.

Figure 2:
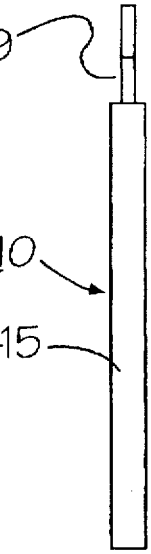
FIG. 2 depicts a side view of the hanger shown in FIG. 1.

The body 15 of hanger 10 is generally flat, as shown in the side, dimensional view of FIG. 2. The body 15 can also have hollowed out sections (not shown), and/or the body 15 can comprise a hollow frame of tubular plastic construction, as best observed with reference to FIG. 3.

Figure 3:
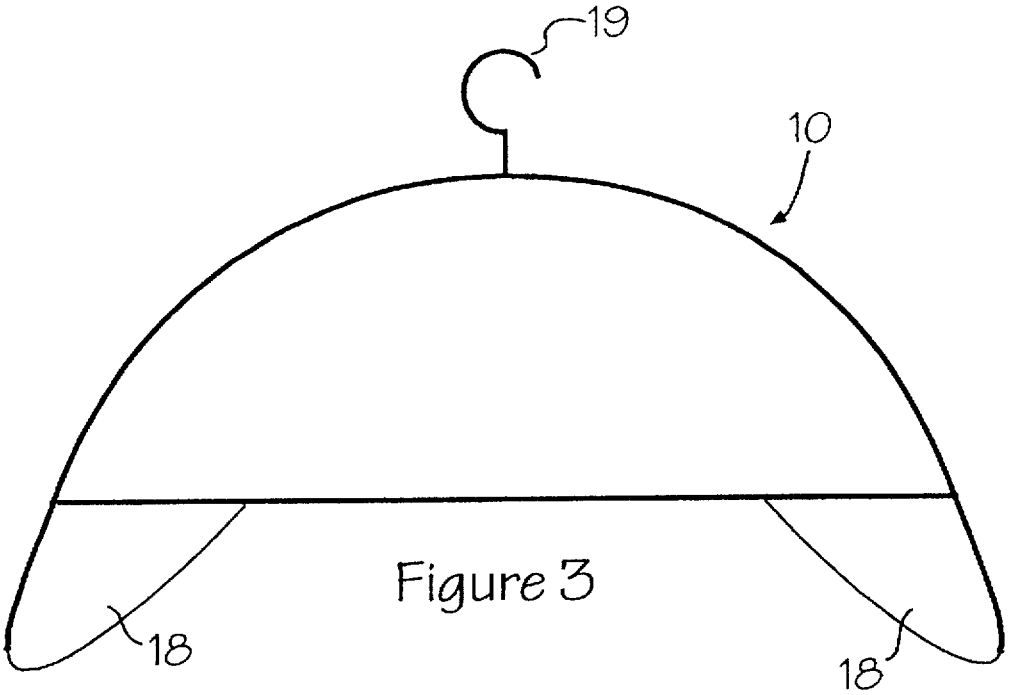
FIG. 3 illustrates a schematic, frontal view of the hanger depicted in FIG. 1, in which the full dimensions are presented.

Referring to FIG. 3, the hanger 10 of this invention is shown in schematic view with dimensional features that are characteristic of the large clothing size for which it has been developed. The body dimensions of the hanger 10 are approximately 20.5" across, approximately 10.25" high, and with a circumference that is approximately 32" from tip-to-tip in length.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A hanger having oversized dimensions that will accommodate clothing of individuals whose clothes size exceeds extra-large, said hanger comprising:

a substantially semi-circular integral, one-piece, hanger body, with a circumferential length dimension that is enhanced by two dog-ears, with each of said dog-ears being respectively disposed on a distal end of said hanger body, each of said dog-ears having an elongated, substantially parabolic shape having two edges, one edge being a curved outside edge which is part of the semi-circle and the other edge being a substantially straight inside edge which is connected directly to a horizontal chord connecting the inside edges of the dog-ears said hanger body having body dimensions of approximately 20.5" across, approximately 10.25" high, and with a circumference that is approximately 32" in length from distal end to distal end; and a hook portion connected to said hanger body for attaching said hanger to a closet pole or wall protuberance.

2. A hanger having oversized dimensions that will accommodate clothing of individuals whose clothes size exceeds a normal range, said hanger comprising: a substantially arcuate integral, one-piece, hanger body, with a circumferential length dimension that is enhanced by two dog-ears, with each of said dog-ears being respectively disposed on a distal end of said hanger body, each of said dog-ears having an elongated, substantially parabolic shape having two edges, one edge being a curved outside edge which is part of the arcuate shape and the other edge being a substantially straight inside edge which is connected directly to a horizontal chord connecting the inside edges of the dog-ears said hanger body having body dimensions of approximately 20.5" across, approximately 10.25" high, and with a circumference that is approximately 32" in length from distal end to distal end; and a hook portion connected to said hanger body for attaching said hanger to a closet pole or wall protuberance.

3. A hanger having oversized dimensions that will accommodate clothing of individuals whose clothes size exceeds a normal range, said hanger comprising:

a substantially arcuate, tubular, integral, one-piece, hanger body, with a circumferential length dimension that is enhanced by two dog-ears, with each of said dog-ears being respectively disposed on a distal end of said hanger body, each of said dog-ears having an elongated, substantially parabolic shape having two edges, one edge being a curved outside edge which is part of the arcuate shape and the other edge being a substantially straight inside edge which is connected directly to a horizontal chord connecting the inside edges of the dog-ears said hanger body having body dimensions of approximately 20.5" across, approximately 10.25 high, and with a circumference that is approximately 32" in length from distal end to distal end; and a hook portion connected to said hanger body for attaching said hanger to a closet pole or wall protuberance.

* * * * *